United States Patent [19]

Jacomini

[11] 4,192,235

[45] Mar. 11, 1980

[54] RADIANT-ENERGY CONTROLLED PROXIMITY FUZE

[75] Inventor: Omar J. Jacomini, Severna Park, Md.

[73] Assignee: The United States of America as represented by the Secretary of the Air Force, Washington, D.C.

[21] Appl. No.: 381,272

[22] Filed: Jul. 8, 1964

[51] Int. Cl.[2] ..... F42C 13/04

[52] U.S. Cl. ..... 102/214

[58] Field of Search ..... 102/70.2 P, 214; 343/7 PF

[56] References Cited

U.S. PATENT DOCUMENTS

| | | | |
|---|---|---|---|
| 2,913,716 | 11/1959 | Powell | 102/214 |
| 3,014,215 | 12/1961 | Macdonald | 102/214 |

*Primary Examiner*—Charles T. Jordan

*Attorney, Agent, or Firm*—Joseph E. Rusz; Cedric H. Kuhn utilized with a proximity fuze comprising a receiver arranged to be gain controlled, said receiver being fed the radiant energy reflected by a target, first and second filters, each having predetermined characteristics, said first filter having a predetermined characteristic being essentially a smoothed value of a predetermined voltage over preselected time, said second filter having a characteristic being essentially a smoothed value of said predetermined voltage over said preselected time minus a time seconds earlier, and each directly receiving the output signal from said receiver, an automatic gain control circuit interconnecting said second filter with said receiver, said automatic gain control operating so that the output signal from said first filter is the ratio between said value of said predetermined voltage over said preselected time, and said value of said predetermined voltage over said preselected time minus said time seconds earlier, and a firing circuit for said proximity fuze, said circuit being interconnected to said receiver by way of said first filter and also receiving an output signal from said automatic gain control circuit for addition to the output signal from said first filter.

EXEMPLARY CLAIM

1. A receiver for the transmitter-receiver combination

1 Claim, 4 Drawing Figures

RADIANT-ENERGY CONTROLLED PROXIMITY FUZE

This invention relates to range detection by power measurement and more particularly the detection of range by power measurement and the utilization of such detection for control of proximity fuzes in ground to ground missile applications.

A proximity fuze is essentially a miniature radar transmitter-receiver used in missiles, artillery, shells, bombs, and rockets which trips the firing mechanism when the armed device approaches within a predetermined range of a target. However, in the presence of heavy jamming or in the case of failure of other fuzing methods, it is desirable to measure received power to determine when to explode the missile.

In accordance with the present invention, a signal is emitted from the transmitter of the fuze, and the reflected signal is picked up by the fuze receiver. The reflected signal is sent to first and second filters which have predetermined characteristics. An automatic gain control (AGC) circuit in combination with aforesaid fuze receiver divides the output of the first filter by the output of the second filter. The signal representing the quotient is applied to trigger the firing circuit of the proximity fuze. The characteristics of the filters are so selected to provide a rapidly increasing non-linear response as the missile approaches the target and as the range accordingly approaches zero.

An object of the present invention is to provide a system for measuring reflected power from a target to determine when to actuate a proximity fuze for firing of a missile.

The various features of novelty which characterize this invention are pointed out with particularity in the claims annexed to and forming a part of this specification. For a better understanding of the invention, however, its advantages and specific objects obtained with its use, reference should be had to the accompanying drawings and descriptive matter in which is illustrated and described a preferred embodiment of the invention.

IN THE DRAWINGS

Figure 3:
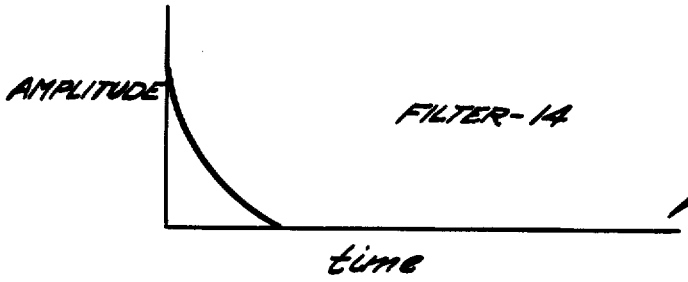
Figure 4:
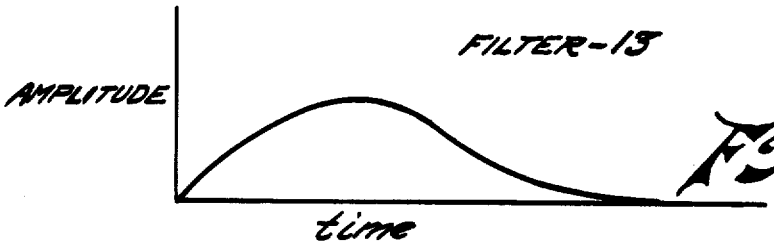

FIG. 3 shows a curve for the impulse response of filter 14 illustrated in block diagram 2; and FIG. 4 shows a curve for the impulse response of filter 13 illustrated in block diagram 2.

Figure 2:
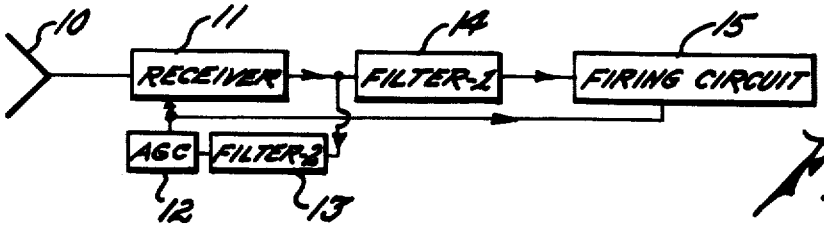
FIG. 2 shows a block diagram of a preferred embodiment of the present invention.

For a clearer understanding of the mode of operation of the system shown in FIG. 2, there follows a brief description relating to radar power.

The received voltage from a radar illuminating the ground or the received voltage from an external source of power will equal $$E=K/R$$

where

E is the received voltage

R is the range

K is proportional to the ground reflectivity or the strength of the external power source E and R are functions of time, K is essentially a constant.

The ratio between the received power at time t and the received power at a time $t_o$, seconds earlier is equal to $$E(t)/E(t-t_o)=R(t-t_o)/R(t)$$

Now $R(t-t_o)=R(t)+Vt_o$ where V is the velocity of closure.

In the system of the present invention the velocity of closure is a fixed known value. In other types of systems it could be measured by doppler shift.

From the above equations $$E(t)/E(T-t_o)=[R(t)+Vt_o]/R(t)=F(R)$$

Figure 1:
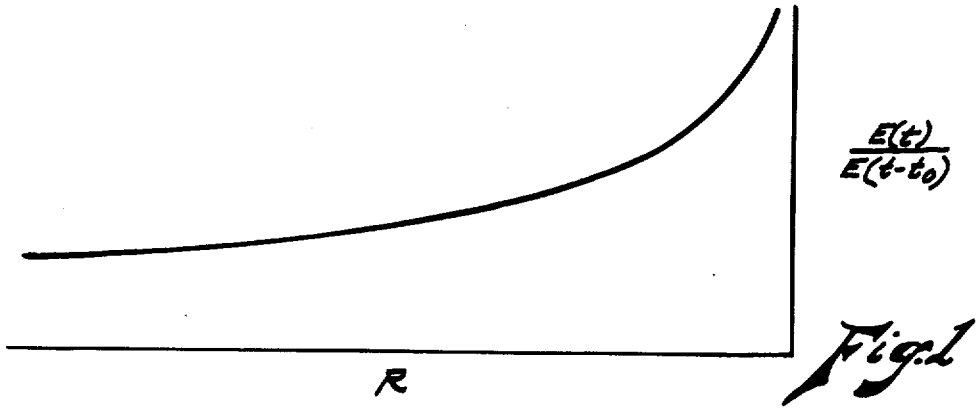
FIG. 1 shows a curve of range against the ratio of received power at time, t, and the received power at a time, $t_o$, seconds earlier.

A plot of this equation for a fixed V and $t_o$ appears as shown in FIG. 1.

By measuring $E(t)/E(t-t_o)$ the corresponding value of R can be ascertained. In the fuzing system of the preferred embodiment of the present invention the firing range will correspond to a fixed value of $E(t)/E(t-t_o)$.

The system for performing the necessary computation is shown in FIG. 2. There is illustrated therein only the receiving portion of the system. It is well understood in the prior art that a transmitter-receiver combination is incorporated with the fuze as shown and described in U.S. Pat. No. 3,027,842 issued Apr. 3, 1962. The present invention resides in the receiver system shown in FIG. 2 wherein antenna 10 receives the signal reflected by a target which is then passed through receiver 11. It is to be noted that receiver 11 is controlled by way of automatic gain control (AGC) circuit 12.

Filter 13 having an impulse response as shown in FIG. 4 is fed the output signal from receiver 11 which is then passed to AGC circuit 12 back to receiver 11. It is thus clear that the gain of receiver 11 is controlled in accordance with the output signal therefrom as modified by filter 13. The output signal from receiver 11 is also passed through filter 14 having an impulse response as shown in FIG. 3.

The output of filter 14 is essentially a smoothed value of E(t) and the output of filter 13 is essentially a smoothed value of $E(t-t_o)$. AGC circuit 12 in effect divides the output of filter 14 by the output of filter 13 essentially producing a smooth value of $E(t)/E(t-t_o)$.

The fact there is not a precise measurement of $E(t)/E(t-t_o)$ will alter the shape of its curve as shown in FIG. 1 but it will not change the fact that a given range will correspond to a given value of the smoothed $E(t)/E(T-t_o)$ output which is fed into firing circuit 15 and when the desired value of voltage is obtained the missile will be fired. The firing circuit may be conventional such as shown and described in U.S. Pat. No. 2,913,716 issued May 6, 1952. It is to be noted that AGC circuits tend to have larger output for large input signals than for smaller input signals. This deficiency is compensated for by adding a portion of the AGC voltage from AGC circuit 12 to the decision voltage from filter 14 for the required firing. This addition circuit may be included in firing circuit 15 and is a conventional one and is positioned at the input of firing circuit 15. It may be more convenient in certain instances to have aforesaid addition circuit as a separate unit from firing circuit 15 and it may interconnect filter 14 and firing circuit 15. The addition circuit would then have two inputs, one from filter 14 and the other from AGC circuit 12 and the single output signal therefrom would be fed to firing circuit 15.

What is claimed is:

1. A receiver for the transmitter-receiver combination utilized with a proximity fuze comprising a receiver arranged to be gain controlled, said receiver being fed the radiant energy reflected by a target, first and second filters, each having predetermined characteristics, said first filter having a predetermined characteristic being essentially a smoothed value of a predetermined voltage over a preselected time, said second filter having a characteristic being essentially a smoothed value of said predetermined voltage over said preselected time minus a time seconds earlier, and each directly receiving the output signal from said receiver, an automatic gain control circuit interconnecting said second filter with said receiver, said automatic gain control operating so that the output signal from said first filter is the ratio between said value of said predetermined voltage over said preselected time, and said value of said predetermined voltage over said preselected time minus said time seconds earlier, and a firing circuit for said proximity fuze, said circuit being interconnected to said receiver by way of said first filter and also receiving an output signal from said automatic gain control circuit for addition to the output signal from said first filter.

* * * * *